United States Patent [19]

Bhowal et al.

[11] Patent Number: 4,843,856

[45] Date of Patent: Jul. 4, 1989

[54] METHOD OF FORGING DUAL ALLOY BILLETS

[75] Inventors: Prabir R. Bhowal; James R. Becker; George K. Korinsky; Noshir M. Bhathena, all of Houston, Tex.

[73] Assignee: Cameron Iron Works USA, Inc., Houston, Tex.

[21] Appl. No.: 112,395

[22] Filed: Oct. 26, 1987

[51] Int. Cl.[4] ..... B21J 3/00

[52] U.S. Cl. ..... 72/41; 72/700

[58] Field of Search ..... 29/DIG. 18, DIG. 25, 29/156.8 R; 72/41, 42, 47, 258, 700

[56] References Cited

U.S. PATENT DOCUMENTS

| | | | |
|---|---|---|---|
| 3,545,240 | 12/1970 | Kent | 72/41 |
| 4,129,022 | 12/1978 | Thonnes et al. | 72/41 |
| 4,154,075 | 5/1979 | Spiegelberg | 72/42 |

FOREIGN PATENT DOCUMENTS

| | | | |
|---|---|---|---|
| 1087240 | 4/1984 | U.S.S.R. | 72/41 |
| 1202080 | 8/1970 | United Kingdom | 72/41 |

*Primary Examiner*—E. Michael Combs

[57] ABSTRACT

An improved forging billet of dual alloys and an improved method for forging a dual alloy billet. The billet is cylindrical in shape having an outer tubular portion of one alloy and another alloy filling the central opening through the tubular portion, the ends of the billet include a radial flange of the tubular alloy extending a short distance outward at each end of the billet and having a skirt extending from the outer end of the radial flange axially away from the body of the billet to form a circular opening at each end of the billet which has at least as large a diameter as the outer diameter of the outer tubular portion, and a sandwich structure positioned within each of said circular opening including a plurality of layers of a powdered lubricant, preferably boron nitride lubricant, separated by foil layers, preferably a high purity nickel foil. The method includes the step of forging a dual alloy billet as described above into a disc having an interface between the two alloys which is substantially straight and generally parallel to the axis of the disc. The steps of the improved method include positioning the billet between the dies, providing lubrication with the billet to be sufficient to lubricate between the die surfaces and the billet to produce the desired dual alloy disc and forging the billet by moving the dies toward each other sufficiently to produce the desired forged product.

3 Claims, 5 Drawing Sheets

METHOD OF FORGING DUAL ALLOY BILLETS

BACKGROUND

In the preparation of certain products, such as jet engine discs, by forging of dual or multiple alloy billets, it is preferred that the boundary between the two materials be retained in a relatively straight line parallel with the axis of the disc. In the prior art of forging billets into suitable discs of dual alloy material, the central alloy for the disc is positioned within the center of the billet and the outer disc alloy is a tubular member surrounding the central alloy.

The product of prior art forging of such dual alloy billet is illustrated in the drawings. The interface between the two alloys which has been achieved is shown in FIG. 1 to have a parabolic shape with the central alloy having a very substantially larger diameter at its mid height than at its upper and lower surfaces.

While it has been thought that the secret of being able to have an interface between the two forged alloys which is parallel to the axis is related to the friction between the billet surfaces and the die surfaces, the use of a lubricant such a boron nitride results in a forged disc having an approximately parabolic interface as shown in FIG. 1.

U.S. Pat. No. 3,780,553 discloses the use of lubricant between the forging dies and the billets and of grooves in the surface of the dies which receive lubricant from the surface of the billet as it is forged and make the lubricant available between the die surfaces and the billet throughout the forging process. Such lubrication is not believed to solve the problem addressed by the present application, since the grooves themselves could present additional limiting forces to the movement of the billet during the forging process.

SUMMARY

The present invention relates to an improved forging billet of dual alloys and to an improved method for forging a dual alloy billet. The billet is cylindrical in shape having an outer tubular portion of one alloy and another alloy filling the central opening through the tubular portion, the ends of the billet may include a radial flange of the tubular alloy extending a short distance outward at each end of the billet and having a skirt extending from the outer end of the radial flange axially away from the body of the billet to form a circular opening at each end of the billet which has at least as large a diameter as the outer diameter of the outer tubular portion, and an improved lubrication means including a sandwich structure positioned within each of said circular openings having a plurality of layers of powder lubricant, preferably boron nitride lubricant separated by a plurality of layers of foil, preferably a high purity nickel foil. The method includes the step of forging a billet as described above into a disc having an interface which is substantially straight and generally parallel to the axis of the disc. The steps of the improved method include positioning the billet between the dies, providing lubrication with the billet to be sufficient to lubricate between the die surfaces and the billet to produce the desired dual alloy disc and moving the dies sufficiently to compress the billet into the desired forged product.

An object of the present invention is to provide an improved dual alloy forging process to forge a billet into a disc so that the interface of the two alloys is substantially straight and substantially parallel with the axis of the disc.

Another object of the present invention is to provide an improved forging process in which the friction between the die surfaces and the billet are greatly reduced.

A further object is to provide an improved dual alloy forging billet having improved lubrication means so that the friction between the billet and the forging die surfaces are greatly reduced during forging.

BRIEF DESCRIPTION OF THE DRAWINGS

These and other objects of the present invention are hereinafter set forth and explained with reference to the drawings wherein.

DESCRIPTION OF THE PREFERRED EMBODIMENT

Figure 1:
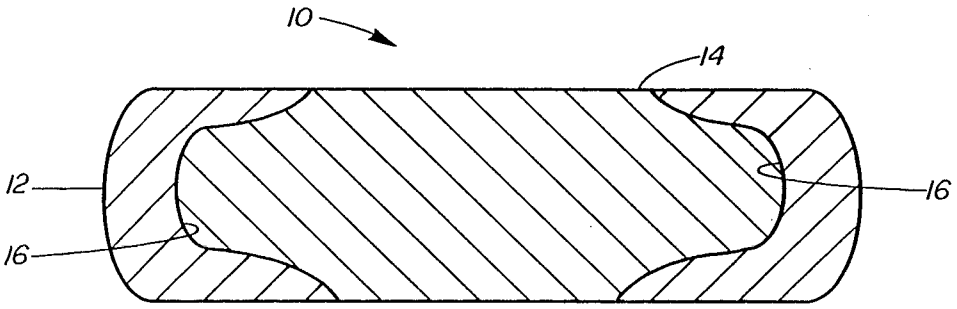
FIG. 1 (PRIOR ART)
FIG. 1 is a sectional view of a prior art dual alloy forged disc showing the position of the alloys and their interface.

As mentioned, FIG. 1 illustrates prior art in the form of forged disc 10 which was forged using a boron nitride lubricant between the surface of the dies and the ends of the dual allow billet. Disc 10 includes outer alloy 12 and central alloy 14. Interface 16 between the two alloys 12 and 14 is in the form of approximately parabolic curves which increase in diameter as the mid height of the disc is approached from either side. Such disc is not satisfactory in the manufacture of dual alloy components such as jet engine discs.

Figure 2:
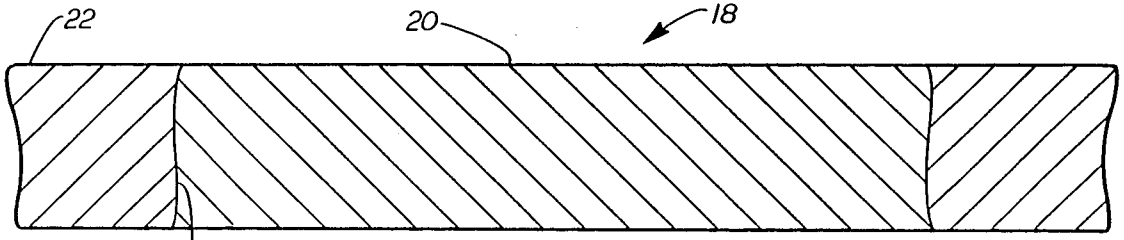
FIG. 2 is a sectional view of a forged dual alloy disc of the present invention.

Disc 18, shown in FIG. 2 and illustrating the improved disc of the present invention, includes inner alloy 20, outer alloy 22 and interface 24 which extends in a substantially straight line which is substantially parallel with the axis of disc 18. Thus, disc 18 provides a dual alloy disc from which jet engine parts may be machined and with the alloys positioned in substantially the desired relationship to each other for the manufacture of such parts.

Figure 3:
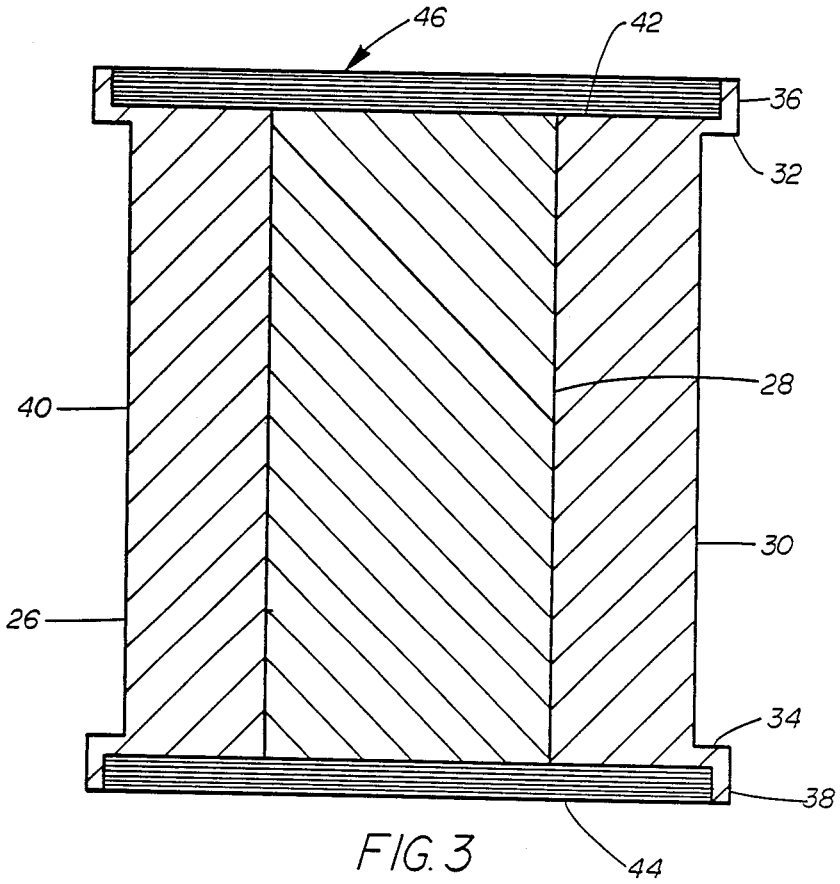
FIG. 3 is an axial sectional view of the improved dual alloy forging billet of the present invention.
Figure 4:
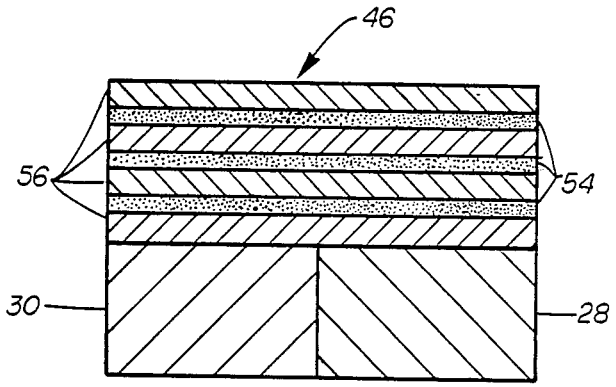
FIG. 4 is a detailed sectional view of a portion of the dual alloy forging billet shown in FIG. 3 to illustrate the relationship of the two alloys and the lubricating means of the present invention.

Disc 18 is produced from billet 26 which is shown in FIGS. 3 and 4. Billet 26 is a dual alloy billet with inner cylindrical core 28 of one alloy and a tubular member 30 tightly surrounding core 28. Billet 26 includes radial flanges 32 and 34 at its respective ends which terminate in axially extending rims 36 and 38 which extend outward from the body 40 of billet 26. Rims 36 and 38 thus provide recesses 42 and 44 at each end of billet 26 with the interior of recesses 42 and 44 having an inner diameter at least as large or larger than the exterior diameter of tubular member 30.

Figure 6:
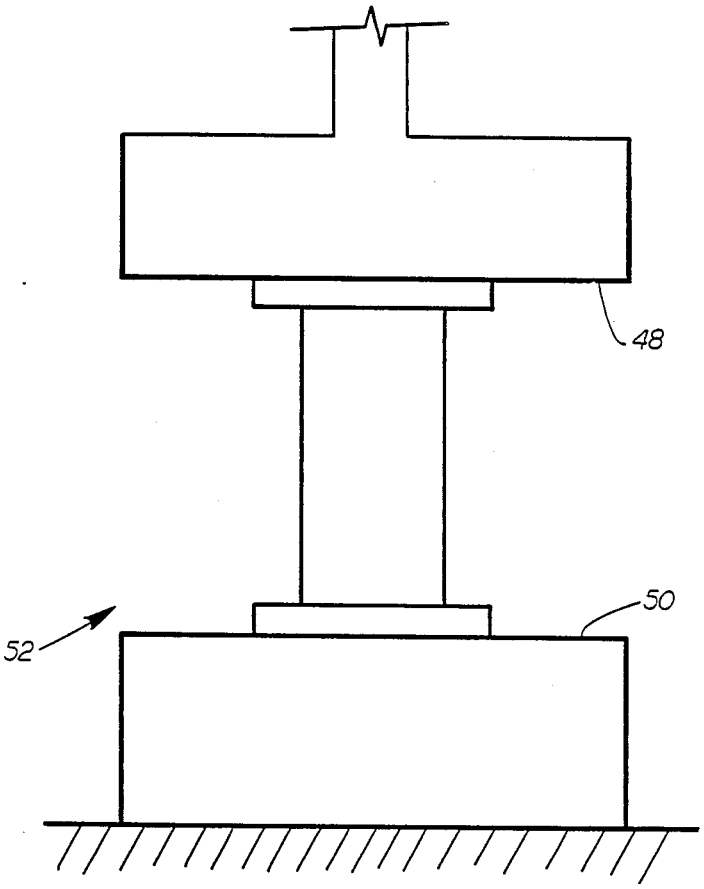
FIG. 6 is a schematic representation of the forging of the improved billet of the present invention.

Improved lubrication 46 of the present invention is positioned within recesses 42 and 44 and provides such improved reduction of friction of the billet 26 against the dies 48 and 50 of the forge 52 (shown in FIG. 6). Lubrication is provided by the alternate layers of powder lubricant 54 and foil 56 as best seen in FIG. 4. The powder lubricant 54 is preferred to be a fine powder lubricant such as boron nitride and the foil is preferred to be a high purity nickel foil. Lubrication 46 is positioned at each end of billet 26 and is held in position by the cup shape of recesses 42 and 44 but if additional retention is needed or if the recesses are not used then some securing means such as spot welding of each layer of foil 56 may be used.

The steps of the improved method include the positioning of the dual alloy billet between the dies of the forging press as shown in FIG. 6, providing the reduced friction as herein described and moving the dies to forge the billet into the desired forged product.

Lubrication 46 of the present invention reduces the friction between billet 26 and dies 48 and 50 sufficiently so that the forging of billet 26 with lubrication 46 produces the forged disc 18 which has the desired relative placement of inner alloy 20 and outer alloy 22 as shown in FIG. 2.

Figure 5:
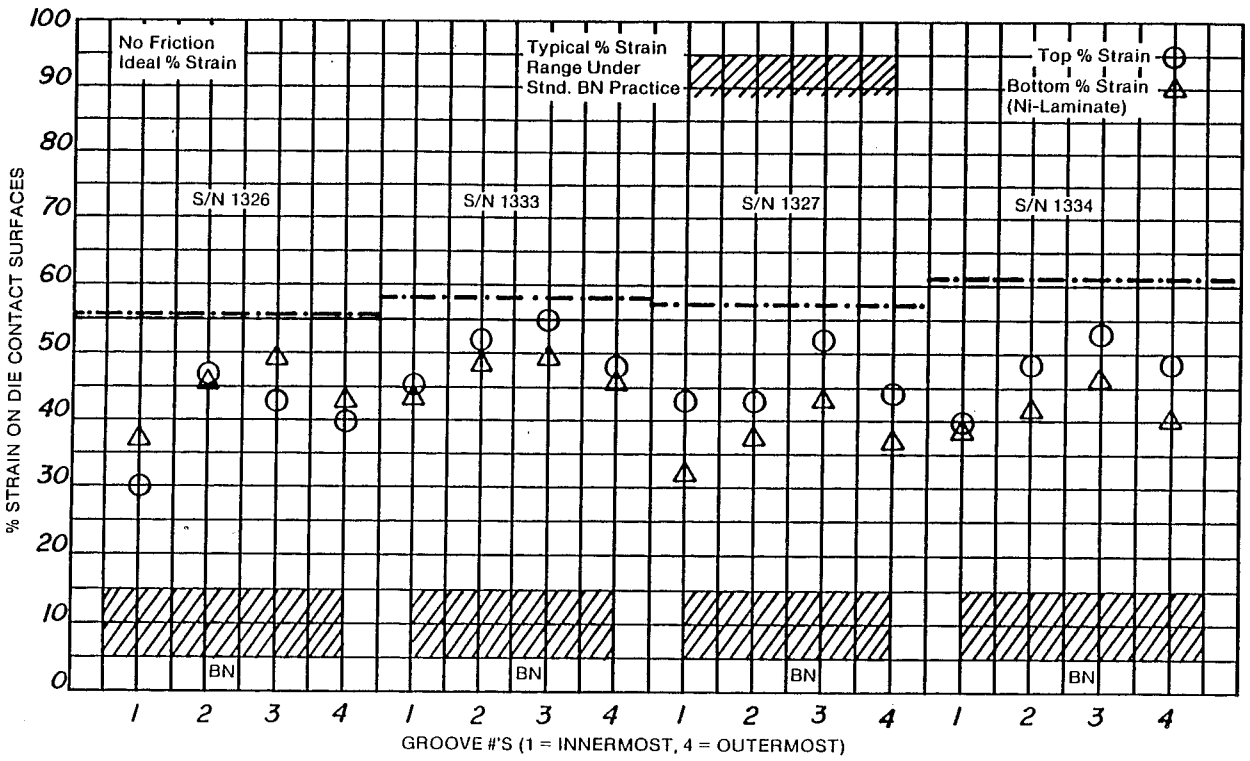
FIG. 5 is a graph showing surface strains on forged discs using the improved lubricating means of the present invention.

Testing was done on the friction developed during the forging of single alloy billets having the improved lubrication sandwich structure of the present invention. Such billets were provided with concentric fine grooves on the top and bottom billet surfaces to monitor friction between the die and the billet on forging. Results from forgings using such billets are shown in FIG. 5. The top and bottom surface strains on the forged billets (calculated from the diametral growth of the fine grooves) were used as a measure of friction. The dotted lines show what the theoretical surface strains should be for each forging if the die-billet contact surface friction were zero (at about 58%). The open circles represent the top surface strains which averaged to 45.7% with a standard deviation of about 6%. The open triangles represent the bottom surface strains which averaged to 42.32% with a similar standard deviation. The data showed an average efficiency of 75.6% in reducing die-billet contact surface frictions. The shaded areas, 0 to 15% strains, are the range of surface strains estimated for forging with a billet using only the prior art boron nitride lubrication. More typically, 5-8% strains would be achieved (approximately 15% efficiency).

What is claimed is:

1. The method of producing a forging disc from a dual alloy billet including the steps of positioning a billet having a core of one alloy and a surrounding tubular member of another alloy between dies of a forging press with the axis of the billet being aligned with the direction of movement of the moving die, lubricating the surfaces of the billet which engage the die surfaces in a manner for forming a forging disc having a structure comprising a central core and a surrounding annular portion of the two alloys and an interface between the two alloys which is substantially straight and parallel with the axis of the forging disc, and moving the dies sufficiently to compress the lubricated billet said forging disc.

2. The method of producing a forging according to claim 1 wherein said lubricating step includes positioning a sandwich structure of multiple alternate layers of metal foil and powder lubricant between the ends of the billet and the die surfaces engaging the billet.

3. The method of producing a forging disc from a dual alloy billet including the steps of positioning a billet having a core of one alloy and a surrounding tubular member of another alloy between dies of a forging press with the axis of the billet being aligned with the direction of movement of the moving die, reducing the friction between the engaging surfaces of the billet and the surfaces of the dies in a manner to provide an increase in the billet surface strain which averages approximately 75% of a predicted zero friction surface strain reduction for forming a forging disc having a structure comprising a central core and a surrounding annular portion of the two alloys and an interface between the two alloys which is substantially straight and parallel with the axis of the forging disc, and moving the dies sufficiently to compress the billet into said forging disc.

* * * * *

UNITED STATES PATENT AND TRADEMARK OFFICE

CERTIFICATE OF CORRECTION

PATENT NO. : 4,843,856

DATED : July 4, 1989

INVENTOR(S) : Prabir R. Bhowal; James R. Becker; George K. Korinsky; Noshir M. Bhathena, all of Houston, TX It is certified that error appears in the above—identified patent and that said Letters Patent is hereby corrected as shown below:

On the title page:

Assignee: Cameron Forge Company
Houston, Texas

Signed and Sealed this

Seventeenth Day of July, 1990

*Attest:*

HARRY F. MANBECK, JR.

*Attesting Officer*

*Commissioner of Patents and Trademarks*